United States Patent [19]

Hall

[11] Patent Number: 4,907,813

[45] Date of Patent: Mar. 13, 1990

[54] ICE HOCKEY SKATE BLADE

[75] Inventor: Kenneth Hall, Pointe Claire, Quebec, Canada

[73] Assignee: Canstar Sports Group Inc., Montreal, Quebec, Canada

[21] Appl. No.: 249,491

[22] Filed: Sep. 27, 1988

[51] Int. Cl.[4] ..... A63C 1/32

[52] U.S. Cl. ..... 280/11.18

[58] Field of Search ..... 280/11.18, 11.17, 11.12

[56] References Cited

U.S. PATENT DOCUMENTS 3,212,786 10/1965 Florjancic et al. ..... 280/11.12
4,131,288 12/1978 Wilson ..... 280/11.18
4,314,708 2/1982 Zuuring ..... 280/11.18

FOREIGN PATENT DOCUMENTS 5912 12/1955 Fed. Rep. of Germany ... 280/11.18
3441058 5/1986 Fed. Rep. of Germany ..... 280/609

*Primary Examiner*—David M. Mitchell
*Attorney, Agent, or Firm*—Samuel Meerkreebs

[57] ABSTRACT

An ice hockey skate blade has a top edge, a skating edge, and a toe portion. The skating edge has a gliding portion behind the toe portion. The gliding portion width is less than the top edge of the blade and the toe portion of the blade. The front toe portion of the blade allows contact with the ice and has a width equivalent to standard hockey ice skate widths, while the gliding portion of the blade behind the toe section has a width corresponding to ice skate racing blades.

2 Claims, 1 Drawing Sheet

FIG. 1
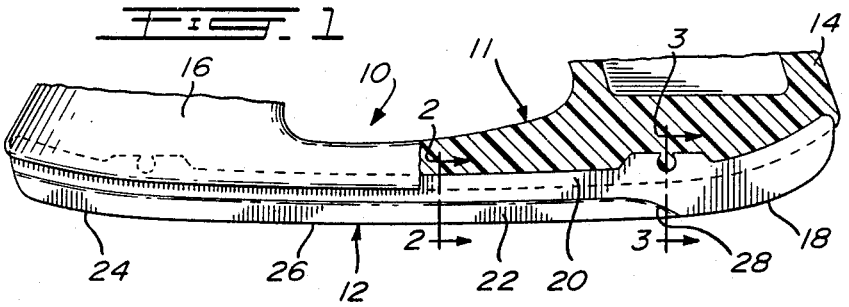
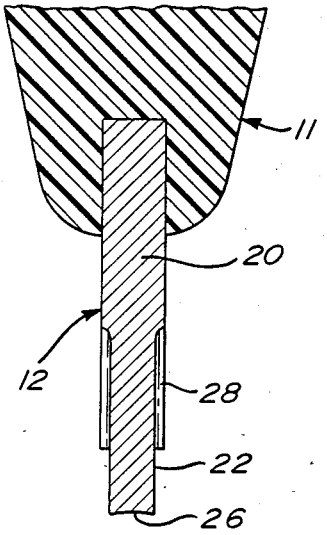
FIG. 2
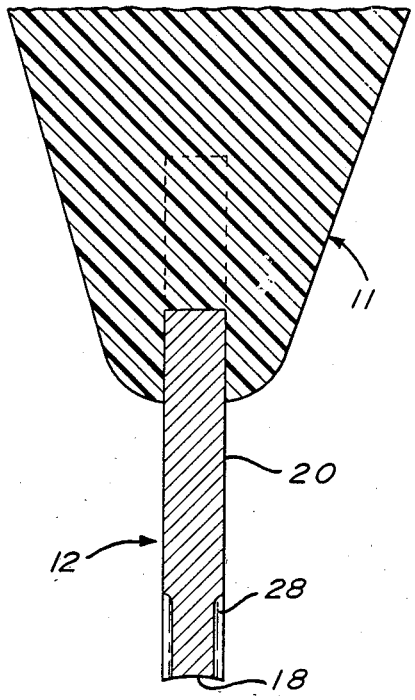
FIG. 3
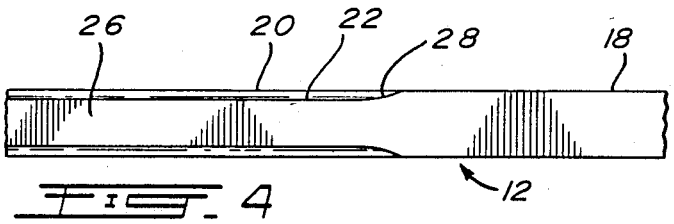
FIG. 4

ICE HOCKEY SKATE BLADE

BACKGROUND OF THE INVENTION

1. Field of the Invention

The present invention relates to ice skate blades, and in particular, to an ice skate blade for use with an ice hockey skate.

2. Description of the Prior Art

A typical ice hockey skate blade has a uniform thickness of approximately 2.9 mm. (0.115 inches). On the other hand, a speed skating blade of the type utilized in Olympic ice skate races is longer than an ice hockey blade, and the thickness of the blade is more in the order of 1.4 mm. It is known that the narrower blade width results in increased gliding speeds and thus the reason for the narrower width on racing skates.

However, hockey skates, and in particular the blades, are subject to violent impacts, such as from hockey pucks, hockey sticks, or other ice skate blades. The hockey skate blade, if it had a thickness of 1.4 mm., would not resist the various impacts to which such blades are subjected. Furthermore, skating patterns during acceleration, braking, and diversion patterns sometimes require violent thrusts of the blade onto the ice surface, particularly in the toe area of the blade. The use of a narrow skate blade, particularly where the ice may be relatively soft, would cause severe grooves in the ice, often slowing down a hockey player and, of course, increasing the already rapid deterioration of the ice surface during a hockey game.

SUMMARY OF THE INVENTION

It is an aim of the present invention to provide an ice hockey blade which incorporates the sturdiness of a thick blade, i.e., of the conventional width of a hockey blade, with a narrow blade portion at least in the glide area of the blade edge.

A construction in accordance with the present invention comprises an ice hockey skate blade of suitable metal having an elongated member with an upper portion and a lower portion. The upper portion is adapted to be encapsulated within a molded plastic blade support, and the lower portion is exposed and includes the skating edge. The blade also includes a toe section, a median section, and a heel section in the longitudinal extent of the blade. The blade is characterized by having different thicknesses, and in particular, the upper portion and toe section have a conventional width in the area of 2.7 to 3 mm. while the lower portion of the blade, in the median section and heel section, has a thickness generally in the range of 1.4 to 2 mm.

BRIEF DESCRIPTION OF THE DRAWINGS

Having thus generally described the nature of the invention, reference will now be made to the accompanying drawings, showing by way of illustration, a preferred embodiment thereof, and in which:

FIG. 1 is a fragmentary side elevation of a skate blade in accordance with the present invention;

FIG. 2 is a lateral vertical cross-section taken along line 2—2 of FIG. 1;

FIG. 3 is a lateral vertical cross-section taken along line 3—3 of FIG. 1; and FIG. 4 is a fragmentary bottom plan view of a detail of the ice skate blade shown in FIG. 1.

DESCRIPTION OF THE PREFERRED EMBODIMENTS

Referring now to the drawings, there is shown a hockey skate blade 10 which includes a molded plastics blade support 11 and a metallic blade 12.

The blade support 11 is of a conventional type which includes a rear pedestal 16 and a front pedestal 14. Not shown are the sole platforms which would be connected to the sole of a skate boot. The blade 12 is constructed such that it has a thinner cross-section in the area of the edge of the skate in the portion of the skate which is used for gliding.

For the purposes of description, the blade can be seen as having, in the longitudinal direction, an upper portion 20 and a lower portion 22. The front area of the skate is identified as a toe section 18, the middle area of the skate is identified as the median section 26, and the tail thereof of the skate is identified as the heel section 24.

As can be seen in the drawings, the upper portion 20 and the toe section 18 of the blade 12 has a uniform thickness. This thickness can vary from 2.7 to 3 mm. and compares with the thickness of a conventional hockey skate blade.

The lower portion 22 of the blade in the median section 26 and heel section 24 has a reduced thickness as shown in the drawings. This reduced thickness can vary between 1.4 and 2 mm. and is roughly the thickness of a race skate blade. The median section 26 and heel section 24 represent generally the gliding portion of the blade on the ice, while the toe section 18 is the portion of the blade which is used in acceleration and is the section of the blade which more frequently comes into contact with the ice when the blade first touches the ice.

It is important that the toe section 18 be of a wider thickness or at least the thickness of a conventional hockey skate blade so as to prevent the blade from digging into or unduly grooving the ice surface. Thus, since the toe section comes into contact more frequently with the ice on the initial thrust, the toe section 18 has the wider thickness. On the other hand, after the initial thrust, the blade is glided in a skating pattern, and thus the provision of the narrower blade portion in this area of the edge allows for an increase in gliding speeds similar to that obtained with racing skates.

The toe section will vary in length depending on the size of the skate. The area of interface between the narrow portion of the skate and the toe section 18, identified at 28, is roughly below the ball of the foot. It is well known that a person's foot grows two thirds forward of the heel while the heel grows in a proportion of one third. Thus, for a larger boot, the toe section 18 will be much longer than on a smaller boot. For instance, a skate boot that has a 280 mm. sole, requires a blade having a toe section 18 which has a projected longitudinal length of 59 mm. This length is measured as a straight line onto which the curved toe section is projected. The straight line is tangential to the curved skate blade edge taken at the median or center of the blade. The interface 28 in the example described has a radius of 76 mm.

In the embodiment illustrated, the vertical extent of the lower portion 22 is 8.5 mm. That is, the reduced thickness portion represents the lower portion 22.

The reduced thickness portion 22 would be produced by grinding a regular hockey skate in the area determined in the present application.

I claim:

1. An ice hockey skate blade of suitable metal comprising an elongated member with an upper portion and a lower portion, the lower portion including the skating edge, the blade including a toe section, a median section, and a heel section in the longitudinal extent of the blade, characterized by the blade having, in the upper portion and toe section, planar parallel side surfaces and having a width in the range of 2.7 to 3 mm. while the lower portion of the blade, in the median section and heel section, has planar parallel side surfaces having a width in the range of 1.4 to 2 mm., the side surfaces of the toe section merging with side surfaces of the upper portion of the median section at the interface thereof by curved concave surfaces extending from the lower toe to the upper median sections, and the interface is in the area of the ball of the foot.

2. An ice hockey skate blade as defined in claim 1, wherein the radius of the curved concave surfaces at said interface is 76 mm.

* * * * *